US005458049A

United States Patent [19]

Shinler et al.

[11] Patent Number: 5,458,049

[45] Date of Patent: Oct. 17, 1995

[54] TWO-STAGE EXTERNALLY ADJUSTABLE CONTROL VALVE

[75] Inventors: Kevin L. Shinler, North Branch Chisago; Alvin S. Rost, Fridley, both of Minn.

[73] Assignee: Dana Corporation, Toledo, Ohio

[21] Appl. No.: 252,009

[22] Filed: May 31, 1994

[51] Int. Cl.[6] ..... F15B 11/00; F15B 13/00

[52] U.S. Cl. ..... 91/512; 91/517; 91/518; 91/461

[58] Field of Search ..... 91/512, 517, 518, 91/461, 533, 170 R, 174, 177, 183, 429; 60/426; 137/596.2, 489.5, 540

[56] References Cited

U.S. PATENT DOCUMENTS

| | | | |
|---|---|---|---|
| 2,812,055 | 11/1957 | Wenger. | |
| 2,954,011 | 9/1960 | Krehbiel | 91/183 |
| 2,981,287 | 4/1961 | Caslow. | |
| 3,304,953 | 2/1967 | Wickline et al.. | |
| 3,340,897 | 9/1967 | Nevulis | |
| 3,502,109 | 3/1970 | Striaght | |
| 3,765,181 | 10/1973 | Lang et al. | 91/518 X |
| 4,253,382 | 3/1981 | Yip | 91/517 X |
| 4,588,163 | 5/1986 | Christensen | 137/540 X |
| 5,036,750 | 8/1991 | Katayama | 137/596.2 X |

*Primary Examiner*—Edward K. Look
*Assistant Examiner*—Hoang Nguyen
*Attorney, Agent, or Firm*—Millen, White, Zelano, & Branigan

[57] ABSTRACT

Material such as trash or refuse is packed in a container by opposed hydraulic packing and ejecting cylinders. Each cylinder is controlled by a hydraulic control valve with the control valve controlling the ejecting cylinder being, in effect, operated by the control valve for the packing cylinder. This is accomplished by sensing the pressure applied to the packing cylinder and when the pressure reaches a predetermined level, a pilot dump valve, in the ejecting cylinder is opened to allow the piston in the ejecting cylinder to retreat. When the pilot pressure drops below the predetermined level, the pilot dump valve closes, allowing the packing cylinder to exert additional packing force. In this way the piston in the ejecting cylinder inches back and the material is intermittently packed. An anti-cavitation check is provided so as to fill the chamber of the ejecting cylinder as the piston retracts.

13 Claims, 2 Drawing Sheets

TWO-STAGE EXTERNALLY ADJUSTABLE CONTROL VALVE

The present invention relates to a two-stage externally adjustable control valve. More particularly, the present invention relates to a two-stage externally adjustable control valve which is used in a system for compacting material.

BACKGROUND ART

There are a wide number of situations in which material is packed or compressed in order to reduce its volume for transport and storage or perhaps for further use in a compacted state. One wide application of packing technology is in refuse disposal wherein a variety of loose solid articles of various sizes, shapes and materials are loaded into vehicles and reduced in volume by compaction. In one type of arrangement, refuse material is placed in a container portion of a vehicle. The container portion includes a packing piston and an ejecting piston which work in opposition to one another. The packing piston is driven by a packing cylinder while the ejecting piston is driven by an ejecting cylinder. After the material is loaded in the container portion of the vehicle, the packing cylinder is advanced to squeeze the material against the ejecting piston while the ejecting piston retreats. Thereafter, the packing piston is withdrawn and the ejecting piston pushes the material in a compact state from the container.

While the aforedescribed arrangement for refuse trucks is widely employed, there is a need for improvement by reducing the volume of the material being compacted as much as possible so that the cost of transporting, storing and disposing of the material can be reduced.

SUMMARY OF THE INVENTION

It is a feature of the present invention to provide a new and improved two-stage, externally adjustable control valve useful in compacting systems.

In view of this feature and other features, the present invention contemplates an improvement in an arrangement for packing materials in a container with an ejecting cylinder and a packing cylinder, wherein the packing cylinder includes a first piston dividing the packing cylinder into packing advance and packing retract chambers and the ejecting cylinder includes an ejecting piston dividing the ejecting cylinder into ejecting advance and ejecting retract chambers. A packing control valve has a first work port connected to the packing advance chamber and a second work port connected to the packing retract chamber. The packing control valve controls the packing cylinder while an ejecting control valve controls the ejecting chamber. Like the packing control valve, the ejecting control valve has a first work port connected to an ejecting advance chamber and a second work port connected to an ejecting retract chamber. Most control valves include a valve spool shiftable between an advance position in which hydraulic fluid flows from a sump into the advance chambers while flowing from the retract chambers into the sump and a retract position in which hydraulic fluid flows into the retract chambers from the sump and from the advance chambers into the sump. The improvement in this arrangement comprises a pilot dump valve, having a preselected operating pressure, disposed in the ejecting control valve between a first work port and the spool. The pilot dump valve connects the first work port of the ejecting control valve to an exhaust core within the ejecting control valve upon the preselected operating pressure being applied to the pilot dump valve. A pilot line connects the first work port of the packing control valve to the pilot dump valve so that when hydraulic pressure at the first work port of the packing control valve exceeds the preselected operating pressure of the pilot dump valve, the pilot dump valve connects the second work port of the ejecting control valve to the exhaust core, allowing the ejecting piston to retract.

In another aspect of the present invention, the invention also contemplates a hydraulic control valve having a valve body which includes a pressure core and an exhaust core with the valve body further including first and second work ports and a valve spool shiftable from a neutral position to either a first position in which the first work port is connected to the pressure core and the second work port is connected to the exhaust core or a second position in which the first work port is connected to the exhaust core and the second work port is connected to the pressure core. The improvement to the control valve comprises a pilot chamber disposed in the valve body between the first work port, the pressure core and the exhaust core, wherein the pilot chamber includes a pilot dump valve connected to a pilot fluid line. In the first mode, the pilot dump valve blocks fluid flow between the first work port and the exhaust core while allowing fluid flow between the first work port and the pressure core. In a second mode, the pilot dump valve allows communication between the first work port and the exhaust core while blocking fluid flow between the first work port and the pressure core. The pilot dump valve is normally biased to the first mode. In accordance with the present invention, pilot pressure, applied by the pilot pressure line, urges the pilot dump valve against the first mode bias to the second mode.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
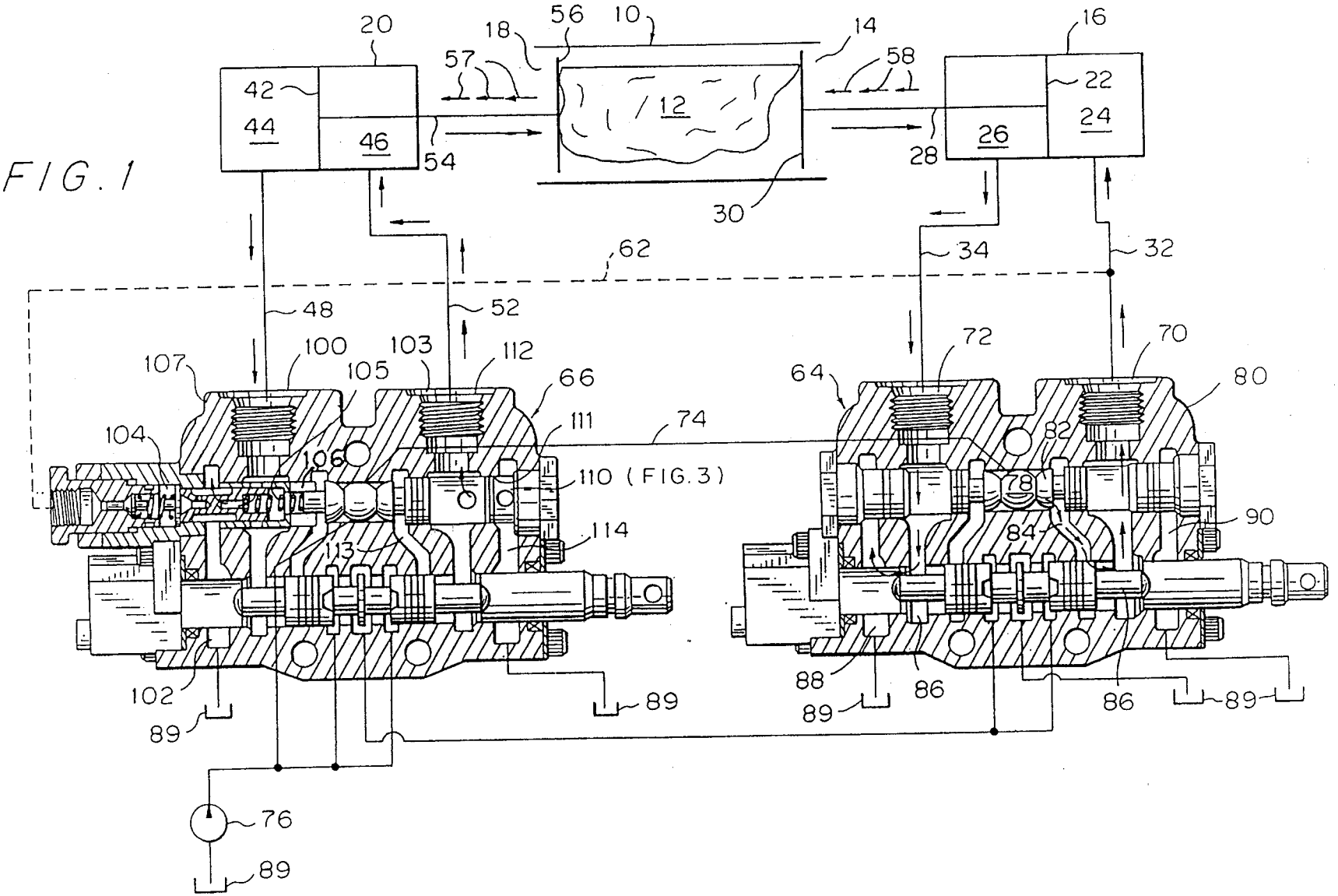
FIG. 1 is diagrammatical view of a material packing system configured in accordance with the principles of the instant invention and including a pair of control valves shown in side elevation.

Operation of the overall System—FIG. 1

Referring now to FIG. 1, there is shown a container 10 which includes a material 12 to be packed. The material 12 to be packed may, for example, be trash or refuse in which the material is solid but contains numerous voids which are eliminated or substantially reduced when the material is compacted.

Disposed proximate a first end 14 of the container is a packing cylinder 16 and disposed proximate a second end 18 of the container is a second packing cylinder 20. The first packing cylinder 16 is divided by a packing piston 22 into a packing advance chamber 24 and a packing retract chamber 26. A piston rod 28 is connected to the piston 22 on one end and has a compacting plate 30 at the other end. A hydraulic line 32 is connected to the packing advance chamber 24 while a hydraulic line 34 is connected to the packing retract chamber 26. As hydraulic fluid is pumped into the packing advance chamber 24, the piston 22 moves to the left pushing hydraulic fluid out through the line 34 and advancing the compacting plate 30 to compress the material 12.

The ejecting cylinder 20 includes a ejecting piston 42 which divides the ejecting cylinder 20 into an ejecting advance chamber 44 ejecting retract chamber 46. As with the packing cylinder 16, the ejecting cylinder 20 has a hydraulic line 48 connected to the ejecting advance chamber 44 and a hydraulic line 52 connected to the ejecting retract chamber 46. Piston 42 has a piston rod 54 attached at one end thereto and a compacting plate 56 at its other end. When hydraulic fluid is pumped into the ejecting advanced chamber 44, the piston 42 moves to the right for the purpose of ejecting compacted material 12 from the container 10 after the compacting plate 30 operated by the packing cylinder 16 has been retracted.

In accordance with the present invention, the ejecting piston 42 holds the compacting plate 56 in an advanced position so that as the packing cylinder 16 advances the packing plate 30 against the material 12, the compacting plate 56 serves as a stop. As will be explained hereinafter in detail, upon a preselected inlet pressure level being reached in the line 32 connected to the packing advanced chamber 24, the piston 42 in the ejecting cylinder 20 will retreat a short distance until the preselected pressure level is again reached whereupon the piston 42 again retreats. Thus, the compacting plate 56 inches back (as illustrated by arrows 57) as packing plate 30 advances (as illustrated by arrows 58). This results in material 12 being packed to a more consistent density and thus a more repeatable volume than was accomplished with previous packing arrangements.

The inching backing of compacting plate 56 is accomplished by coordinating operation of the packing cylinder 16 with the ejecting cylinder 20 by urging a pilot supply line 62. The pilot supply line 62 is connected to the hydraulic line 32 which connects the packing advance chamber 24 to a packing control valve 64. The pilot supply line 62 serves as a sensor line which connects line 32 to an ejecting control valve 66 so that output pressure from the packing control valve 64 is monitored by and reacted to by the ejecting control valve 66.

Control valves 64 and 66 are generally similar in configuration, generally operate and include features of a control valve known as the V20 available from the Mobile Fluid Products Division of the Dana Corporation located in Minneapolis, Minn. The packing control valve 64 includes a first working port 70 connected to the line 32 for pressurizing the packing advantage chamber 24 and a second work port 72 connected to by the hydraulic line 34 to the packing retract chamber 26. A pressure line 74 from a hydraulic pump 76 applies pressurized hydraulic fluid to an input port 78 in the body 80 of the packing control valve 64. The input port 78 opens a valve 82 to admit hydraulic fluid to a pressure core 84, which hydraulic fluid flows past a valve spool 86 which is connected by the pressure core 84 to the first work port 70 so as to pressurize the packing advance chamber 24. This causes the piston 22 to move to the left so that the packing plate 30 packs the material 12 in the container 10.

While the packing piston 22 is moving to the left with respect to FIG. 1, fluid in the packing retract chamber 26 is exhausted through line 34 which is connected to the second work port 72 of the packing valve 64. The fluid from chamber 26 flows into exhaust core 88 past the spool 86 and to the tank or sump 89 of the system. In this way, the packing piston 22 advances the packing plate 30 to compress the material 12 in the chamber 10.

When it is desired to retract the packing plate 30, the process is reversed in a conventional manner by pushing the spool 86 to the right so that fluid is pressurized on line 34 and exhausts to the sump 89 via an exhaust core 90.

Referring now to the ejecting control valve 66, the ejecting control valve connects the ejecting advance chamber 44 to a first work port 100 to advance the piston 42 when the first work port is in communication with a pressure core 101. When the first work port 100 is in communication with an exhaust core 102, hydraulic fluid is exhausted from the ejecting advance chamber to the sump 89 via passage through an exhaust core 102 and through a pilot dump valve 104 (biased closed by a spring 105) positioned in a pilot chamber 106 disposed in the body 107 of the ejecting control valve. The pilot dump valve 104 is connected by the pilot supply line 62 to the pressure line 32. As will be explained in detail hereinafter, when the pressure in the line 32 reaches a preselected level. The chamber 44 exhausts, allowing the ejecting piston 42 to retreat slightly until the pressure drops in chamber 24 and thus in the pilot supply line 62. The piston 42 then remains in its new position until the preselected pressure level is reached again, at which time it again retreats.

As the ejecting piston 42 retreats, pressurized fluid on line 52 should flow into the ejecting retract chamber 46. This is accomplished by an internally disposed, anti-cavitation, check valve 110 disposed in a cavity 111 in the body 107 of the ejecting control valve 66. The anti-cavitation check valve allows pressurized oil to fill the ejecting retract chamber 46 as the piston 42 inches back.

When the piston 42 retreats to its final position, the material 12 in the container 10 is considered packed, whereupon the piston 22 of the packing cylinder 16 is retracted to back the packing plate 30 from the container 10. The work port 100 of the ejecting control valve 66 is then pressurized to send fluid over line 48 into the ejecting chamber 44 while fluid exhausts over line 52 from the chamber 46, thus causing the compacting plate 56 to push the now compacted material 12 out off the container 10.

Figure 2:
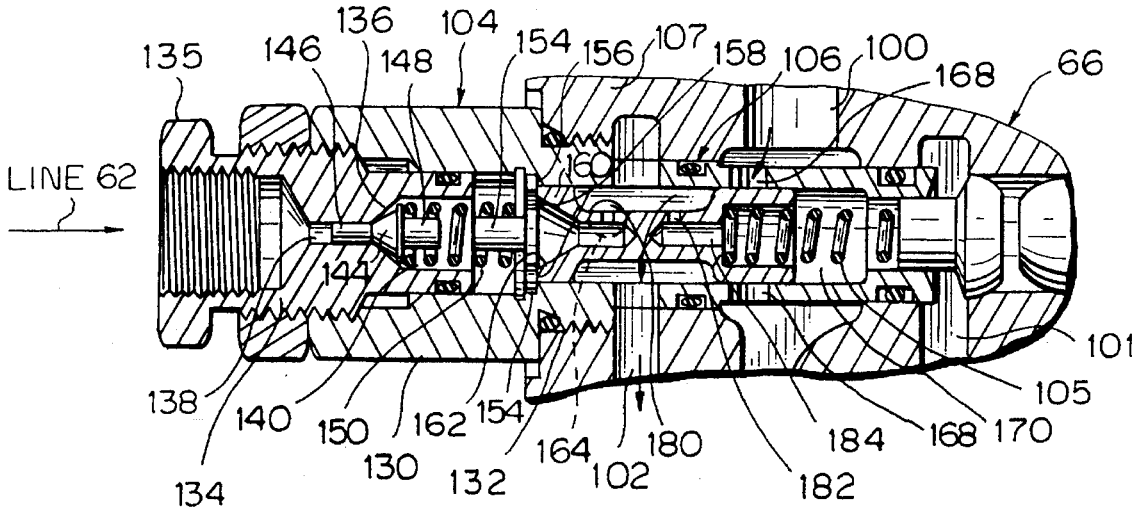
FIG. 2 is a side elevation of a pilot dump valve installed in a pilot chamber of one of the control valves shown in FIG. 1.

Operation of the Pilot Dump Valve 104—FIG. 2

Referring now to FIG. 2 in combination with claim 1, the pilot dump valve 104 is shown received within the pilot chamber 106 in the body 107 of the ejecting control valve 66. The pilot dump valve 104 is disposed between the first work port 100 and the exhaust core 102 so as to normally prevent flow of hydraulic fluid from the first work port 100 to the exhaust core 102 when in a first mode and to allow flow when in a second mode. The pilot dump valve 104 is biased by the coil spring 105 to the first mode (wherein flow of fluid from the first work port 100 to the exhaust core 102 is blocked). A second work port 112 (see FIG. 1) is connected by the line 52 to the retract chamber 46 (FIG. 1). The second work port 112 (FIG. 1)is connected to a second pressure core 113 and a second exhaust core 114 in the ejecting control valve 66.

The pilot dump valve 104 is comprised of an outer sleeve 130 which is threaded to the valve body 107 at threaded opening 132. The outer sleeve 130 has at outer end a popper valve seat 134 into which a fitting 135 for the line 62 is threaded and which has disposed therein a conical seat 136 aligned with a narrow bore 138 and a wide bore 140. Disposed in alignment with the valve seat 136 is a poppet valve 144 which has a stem 146 received in the narrow bore 138 and a circular lug 148 projecting into the wide bore 140. Disposed around the circular lug 148 is a coil spring 150 which is seated around a second circular lug 152 which is unitary with and projects from a stop 154 that engages an internal shoulder 156 in the sleeve 130. The stop 154 has openings 158 therethrough so that fluid can flow past the stop. When pressure on the pilot line 62 exceeds the predetermined level, the poppet 144 is forced away from valve seat 136 so that hydraulic fluid flows past the conical poppet 144 into the wide bore 140 and thereafter through the openings 158 in the stop 154.

Disposed behind the stop 154 is a piston 160 with a conical end 162. The hydraulic fluid impinging on the conical end 162 of the piston and the end of bore 164 in the piston moves the piston to the right against the bias of spring 105. This causes ports 168 in the sleeve 130 to open allowing fluid in work port 100 to flow past the enlarged end 169 of the piston 160 and into the interior 170 of the sleeve 130 which communicates directly with the exhaust core 102. Hydraulic fluid 20 drains down line 48 (FIG. 1) under the urging of the ejecting piston 42 which pushes the fluid from the chamber 44. The fluid from chamber 44 then flows from the exhaust core 102 to the sump 89 (FIG. 1).

The retreat of the piston 42 (FIG. 1) to the left causes pressure in the chamber 24 of packing cylinder 16 to drop which lowers the pressure in line 62, allowing the poppet 144 to return against the seat 136 due to the bias of spring 150. When the poppet 144 closes, spring 105 returns the piston 160 to its closed position by forcing the piston to the left in FIG. 2. As the piston is forced to the left, hydraulic fluid trapped therein flows out through an orifice 180 into the exhaust core 102 and from the exhaust core 102 into the sump 89. The exhaust core 102 is also in communication with an orifice 182 in a bore 184 in which the spring 105 seats so that when the piston 160 is again pushed to the right by pilot pressure on line 62 to uncover the bore 168, hydraulic fluid which may have become trapped behind the piston and is in the bore 184 can flow through bore 184 and orifice 182 and into the exhaust core 102.

The force on the poppet 144 is controlled by the axial position of the poppet valve seat 134 which is threaded into the sleeve 130. This is accomplished by a locking nut 190 which is tightened against the end 192 of the sleeve 130 so as to lock and position the valve seat 134 with respect to the sleeve. The further the valve seat 134 is advanced into the sleeve 130, the more force the spring 150 exerts on the poppet 144 and the higher the pressure required to open the poppet 144.

Figure 3:
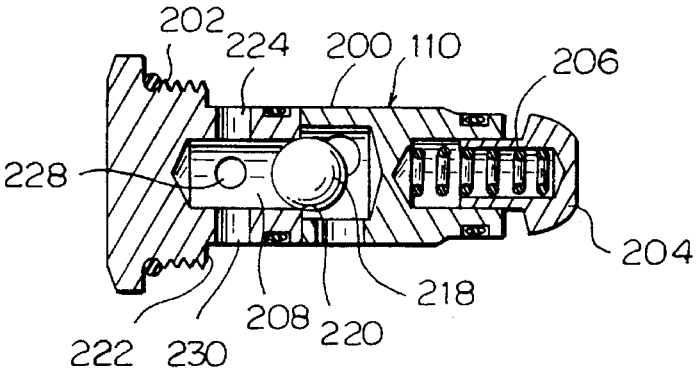
FIG. 3 is a side elevation of an anti-cavitation, check assembly mounted in the same control valve in which the pilot dump valve is mounted.

Operation of the Anti-Cavitation, Check Valve 110—FIG. 3

Referring now to FIG. 3 in combination with FIG. 1, the anti-cavitation check valve 110 is mounted within the chamber 111 aligned with the second work port 112. The anti-cavitation check valve 110 is operated by back pressure from the exhaust core 114 connected to the second work port 112 and opens in response to that pressure while closing in response to pressure on line 52 from the second work port 112.

The anti-cavitation check valve 110 is an assembly comprised of a sleeve portion 200 which has a threaded first end 202 that is threaded into the threaded exterior opening of the cavity 111. The cavity provides communication between exhaust core 114 and the second work port 112 of the ejecting control valve 66. The anti-cavitation check valve 110 includes a check valve element 204 which normally closes the inlet 78 for pressurized fluid from the pump 76 (FIG. 1 ). The check valve element 204 is biased closed by a coil spring 206.

A chamber 208 is provided with three openings 210, 211 and 212 which communicate with the second work port 112. Within the chamber 208 is a ball valve 218 which is free to move in and out of engagement with an annular seat 220 on the face of a retaining portion 222 of the check valve 110. The retaining portion 222 includes a chamber 224 which has orifices 226, 228 and 230 which communicate with the exhaust core 114 and connect the work port 112 to the exhaust core via chambers 208 and 224.

As is seen by FIG. 1 in combination with FIG. 3, when fluid flows from the chamber 44 and the piston 42 moves to the left, suction is created on the second work port 112 which pulls fluid from the exhaust core 114 past the ball valve 218 and into the second work port. The fluid then flows into the chamber 46 via line 52 so that oil fills the chamber 46, negating cavitation which would occur in the absence of the chamber 46 being completely filled.

Referring now again to FIG. 1, after the ejecting piston 42 has been intermittently pushed back as far as it will retreat as the material 12 is packed by the packing plate 30, the piston 22 is moved to the right so that the compacting plate 56 can eject the now packed material 12 from the container 10. This is accomplished by reversing fluid flow from the control valve 66 so that line 48 is pressurized and the line 52 serves as an exhaust line to transfer the fluid accumulated in chamber 46 to sump 89.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In an arrangement for packing materials in a container with an ejecting cylinder and a packing cylinder wherein the packing cylinder includes a first piston dividing the cylinder into packing advance and packing retract chambers and the ejecting cylinder includes a ejecting piston dividing the ejecting cylinder into ejecting advance and ejecting retract chambers; a packing control valve having a first work port connected to the packing advance chamber and a second work port connected to the packing retract chamber, and an ejecting control valve having a first work port connected to the ejecting advance chamber and a second work port connected to the ejecting retract chamber, wherein each control valve includes a valve spool which is shiftable between an advance position in which hydraulic fluid flows from a sump into the advance chambers and from the retract chambers into the sump and a retract position in which hydraulic fluid flows into the retract chambers from the sump and from the advance chambers into the sump, the improvement comprising:

a packing dump valve having a preselected operating pressure disposed in the ejecting control valve between the first work port and spool thereof, the pilot dump valve connecting the first work port of the ejecting control valve to an exhaust core within the ejecting control valve upon the preselected operating pressure being applied to the pilot control valve, and a pilot line for connecting the first work port of the packing control valve to the pilot dump valve, wherein when hydraulic pressure at the first work port exceeds the preselected operating pressure of the pilot dump valve, the pilot dump valve connects the second work port of the ejecting control valve to the exhaust core allowing the eject piston to retract.

2. The improvement of claim 1 further including an anti-cavitation check valve positioned in the ejecting control valve between the second work port and the exhaust core for allowing hydraulic fluid to fill the retract chamber as the piston retracts.

3. The improvement of claim 1, wherein the pilot dump valve includes a pilot piston, which upon application of the preselected pressure to the pilot dump valve, is slidable from a first position in which the piston blocks communication between the first work port and the exhaust core of the ejecting control valve and a second position in which the piston permits communication between the first work port and exhaust core of the ejecting control valve, the pilot dump valve further including spring means for urging the piston to the first position.

4. The improvement of claim 3 further including means for bleeding pilot hydraulic fluid past the piston into the exhaust core as the pilot piston returns to the first position.

5. The improvement of claim 4 further including a pilot poppet valve disposed between the pilot piston and the pilot line from the first work port of the packing control valve, the pilot poppet valve being biased to a closed position by a poppet spring exerting the preselected pressure against the poppet valve wherein the poppet valve opens upon the preselected pressure being exceeded by the pressure applied through the pilot line.

6. The improvement of claim 5 further including means for adjusting the predetermined pressure.

7. The improvement of claim 6, wherein the pilot dump valve is disposed within a pilot chamber in the ejecting control valve and wherein the means for adjusting the predetermined pressure is a valve seat which is threadably mounted in the pilot chamber for helical advancement in and out of the pilot chamber to selectively compress the poppet spring.

8. In a hydraulic control valve having a valve body including a pressure core and an exhaust core, the valve body including first and second work ports and a valve spool shiftable from a neutral position to either a first position in which the first work port is connected to the pressure core and the second work port is connected to the exhaust core or a second position in which the first work port is connected to the exhaust core and the second work port is connected to the pressure core, the improvement comprising:

a pilot chamber disposed in the valve body between the first work port, the pressure core and the exhaust core;

a connection for a pilot fluid in communication with the pilot chamber;

a pilot dump valve in the pilot chamber, the pilot dump valve being operable between a first mode in which the pilot dump valve blocks fluid flow between the first work port and exhaust core while allowing fluid flow between the first work port and pressure core and a second mode, in which the pilot dump valve allows communication between the first work port and exhaust core while blocking fluid flow between the first work port and pressure core;

the pilot dump valve includes a pilot piston, which upon application of the preselected pressure to the pilot dump valve, is slidable from a first position in which the piston blocks communication between the first work port and the exhaust core of the ejecting control valve and a second position in which the piston permits communication between the first work port and exhaust core of the ejecting control valve and spring means urging the piston to the first position;

means for biasing the pilot dump valve to the first mode;

means for applying the pilot pressure to the pilot dump valve to bias the pilot dump valve to the second mode; and an anti-cavitation check valve disposed in the valve body between the second work port and the exhaust for blocking flow from the second work port to the exhaust core when the pilot dump valve is in the second mode.

9. In a hydraulic control valve having a valve body including a pressure core and an exhaust core, the valve body including first and second work ports and a valve spool shiftable from a neutral position to either a first position in which the first work port is connected to the pressure core and the second work port is connected to the exhaust core or a second position in which the first work port is connected to the exhaust core and the second work port is connected to the pressure core, the improvement comprising:

a pilot chamber disposed in the valve body between the first work port, the pressure core and the exhaust core;

a connection for a pilot fluid in communication with the pilot chamber;

a pilot dump valve in the pilot chamber, the pilot dump valve being operable between a first mode in which the pilot dump valve blocks fluid flow between the first work port and exhaust core while allowing fluid flow between the first work port and pressure core and a second mode, in which the pilot dump valve allows communication between the first work port and exhaust core while blocking fluid flow between the first work port and pressure core;

the pilot dump valve includes a pilot piston, which upon application of the preselected pressure to the pilot dump valve, is slidable from a first position in which the piston blocks communication between the first work port and the exhaust core of the ejecting control valve and a second position in which the piston permits communication between the first work port and exhaust core of the ejecting control valve and spring means urging the piston to the first position;

means for biasing the pilot dump valve to the first mode; and means for applying the pilot pressure to the pilot dump valve to bias the pilot dump valve to the second mode.

10. The improvement of claim 9 further including a pilot poppet valve disposed between the pilot piston and the pilot line from the first work port of the packing control valve, the pilot poppet valve being biased to a closed position by a poppet spring exerting the preselected pressure against the poppet valve wherein the poppet valve opens upon the preselected pressure being exceeded by the pressure applied through the pilot line.

11. The improvement of claim 9 further including means for bleeding pilot hydraulic fluid past the piston into the exhaust core as the pilot piston returns to the first position.

12. The improvement of claim 11 further including means for adjusting the predetermined pressure.

13. The improvement of claim 10, wherein the pilot dump valve is disposed within a pilot chamber in the ejecting control valve; wherein the means for adjusting the predetermined pressure is a valve seat which is threadably mounted in the pilot chamber for helical advancement in and out of the pilot chamber to selectively compress the poppet spring.

* * * * *